United States Patent [19]

Demny et al.

[11] 4,020,667

[45] May 3, 1977

[54] TUBE ROLLING

[75] Inventors: Werner Demny; Hermann Moeltner, both of Dusseldorf-Oberkassel, Germany

[73] Assignee: Firma Friedrich Kocks, Dusseldorf, Germany

[22] Filed: Oct. 23, 1975

[21] Appl. No.: 624,880

[30] Foreign Application Priority Data

Oct. 23, 1974 Germany ..... 2450224

[52] U.S. Cl. ..... 72/205; 72/234

[51] Int. Cl.[2] ..... B21B 17/00

[58] Field of Search ..... 72/205, 249, 234, 235, 72/208, 209, 365, 366, 367

[56] References Cited

UNITED STATES PATENTS

| | | | |
|---|---|---|---|
| 3,074,300 | 1/1963 | Justus | 72/29 |
| 3,645,121 | 2/1972 | Pfeiffer et al. | 72/205 |

*Primary Examiner*—Milton S. Mehr

*Attorney, Agent, or Firm*—Buell, Blenko & Ziesenheim

[57] ABSTRACT

A multistand rolling mill for stretch reducing tubes is provided in which the first stands of a plurality of successive stands are operated to build up tension and at least one of said stands is provided with means for varying the roll speed to provide a desired speed step in those stands designed to build up tension.

9 Claims, 2 Drawing Figures

TUBE ROLLING

This invention relates to tube rolling and particularly to a method of varying the change in the tube wall thickness during the stretch-reducing rolling of tubes and to a stretch reducing rolling mill for accomplishing the same.

For the purpose of stretch-reducing tubes, during which primarily the wall thickness is reduced and the external diameter of the tubes is also reduced, a plurality of roller stands is used which are arranged directly one behind the other and whose driven rollers rotate at speeds which are progressively higher from stand to stand in the rolling direction. The graduation of the rotational speed from stand to stand is dependent upon the reduction in the diameter, the change in the wall thickness and possible change in the nominal diameter of the rollers from one stand to the next. Thus, for a specific reduction in the diameter of the tube or series of sizing passes of the rolling stands, there is a corresponding change in the wall thickness between the incoming initial tube and the outgoing finished tube with a specific graduation of the rotation speed.

If it is desired to vary this change in the wall thickness, it is necessary to vary the graduation of the rotational speed. In a known rolling mill, this is achieved by providing the individual stands with a separate drive, so that each stand can be individually regulated with respect to its rotational speed. In another known rolling mill (German Pat. No. 970,102) the rotational speeds can be varied by using summation transmission units in the case of a group drive. Such a summation transmission unit comprises a main fixed speed driving motor common to all the strands of the group and an individual small variable speed motor for each stand. The drive to each stand is effected through a differential gear which sums the speeds of the main drive motor and the respective variable speed small motor. Furthermore, a rolling mill is known (German Pat. No. 932,663) in which work is carried out with only one series of rotational speeds as a basic series having a fixed step-up ratio from stand to stand, the graduation of the basic rotational speeds at the beginning and at the end of a row of sizing passes being changed by switching on summation transmission units and introducing additional rotational speeds, thus resulting in different changes in the wall thickness.

These known methods and rolling mills have the disadvantage that the drive for varying the change in the wall thickness is very expensive. This is primarily due to the fact that virtually all the rotational speeds of all the rollers have to be changed. In the case of a rolling mill having individual adjustment, this requires considerable care and is time-consuming, or particularly high technical expenditure is required, particularly on computers and electronic devices, in order to be able to adjust the various rotational speeds of the rollers, thus involving considerable capital expenditure and operating costs.

A feature of the present invention is to provide a method and a rolling mill in which the change in the wall thickness is varied during the stretch-reducing of tubes by changing the rotational speed of the rollers, a method which does not have the above-mentioned disadvantages but which enables the change in the wall thickness to be varied at low expense and in a short period of time.

In accordance with the present invention, during passage through the rolling mill, the tubes are subjected for the first time to the maximum tensile force required for changing the wall thickness, beyond a different tensile force from preceding stands which are located in front in the rolling direction and which build up tension and/or the tubes are subjected at this location to a different tensile force from previously, while the rotational speeds of the rollers of the other stands remain unchanged.

This means that a rotational speed step in the region of the front stands building up tension in stretch-reducing mills is transferred to a different location of the rolling mill and/or the magnitude of this rotational speed step is varied in order to vary the change in the wall thickness without having to vary the rotational speed of the rollers of the other stands. In accordance with the invention, it was recognized that the relocation of the rotational speed step and/or varying the magnitude of the rotational speed step are, in many cases, solely sufficient to achieve adequate variation of the change in the wall thickness. By rotational speed step is meant an interstand difference in roller speed significantly greater than that in the normal progression or graduation of speed increases from stand to stand.

The invention includes a multistand rolling mill for the stretch reducing of tubes in which drives are provided for the rollers of the rolling stands such that the peripheral speeds of the rollers increase from stand to stand and in which the rotational speeds of the rollers of at least one of the stands at which tension is built up and which are located in front in the rolling direction, are individually variable whereby a rotational speed step between at least two stands of those at which tension is built up can be shifted from one location to another and/or is variable in magnitude, the rotational speeds of the rollers of all the other stands of the rolling mill being kept constant.

The method in accordance with the invention has the advantage that the desired effect is achieved solely by varying the rotational speeds of the rollers in only one or two stands of the rolling mill, so that one can dispense with the very expensive devices for adjusting, in conformity with one another, the rotational speeds of all the stands or at least most of the stands. Furthermore, it is advantageous that the time-consuming adjustment of the rotational speeds of the rollers in individually driven rolling stands is avoided. The method in accordance with the invention is particularly advantageous if the rolling operation is to be effected automatically in accordance with measured values, for example in accordance with the wall thickness of the tube entering or leaving the rolling mill.

Basic relationships are set forth hereinafter in order to provide better comprehension of the invention, and particularly to show the importance of the interstand rotational speed step at which the tube is subjected to the full tensile force for the first time.

The force, i.e. the tensile force, which is exerted on the tube in the rolling direction by a roller depends essentially upon the frictional forces in the region of the contact surface between the roller and the tube. These frictional forces are influenced by the ratio of the peripheral velocity of the rollers to the speed at which the tube passes through the rolling mill. This ratio is different at the individual points on the periphery of the tube, since the roller radius is also different at the individual points on the periphery of the tube which are contacted by a roller, while the rotational speed of the roller remains the same. Thus, the peripheral velocities of the roller at all the points on the periphery of the tube, which are contacted by a roller under consideration, can be greater or less than the speed at which the tube passes through the rolling mill. However, it is also possible for the peripheral velocities of a roller to be greater at individual peripheral points of the tube than the velocity at which the tube passes through the rolling mill, and to be smaller at other peripheral points of the tube. In this case, there are points on the periphery of the tube at which the peripheral velocity of the roller and the velocity at which the tube passes through the rolling mill are equal. The distance of these points from the rotary axis of the roller is designated "rolling radius". Thus, the peripheral velocity, calculated from the rolling radius and the rotational speed of the roller, is equal to the speed at which the tube passes through the rolling mill.

According to the ratio of the peripheral velocity of the roller at the individual peripheral points of the tube to the velocity at which the tube passes through the rolling mill, the components of the frictional forces at the elemental surface areas can all be directed in the rolling direction and also in the opposite direction to the rolling direction. On the other hand, some of them can be directed in opposite directions to one another and thus again also be directed in the rolling direction as well as in the direction opposite to the rolling direction. It will readily be seen that in the case of frictional forces directed in the same direction at the individual elemental surface area, the resultant tractive force assumes a maximum value. The direction of the frictional forces is naturally determined by the relative speeds of the roller and the tube at the particular point under consideration. It follows from this that the roller exerts a maximum tractive force upon the tube when, at any point on the contact surface between the roller and the tube, the particular peripheral velocity of the roller is greater than the velocity at which the tube passes through the rolling mill. This is the case when the rolling radius is equal to or smaller than the radius of the roller in the region of the bottom of sizing pass, i.e. in the region of the location on the roller working surface which is machined to the greatest depth in the roller body. The formula:

$$R = \tfrac{1}{2} \cdot (WD - D) \cdot \qquad \text{I}$$

is obtained when the corresponding diameters are chosen instead of the radii. In this formula, R represents the rolling radius, D represents the external diameter of the tube, and WD represents the ideal roller diameter which is equal to twice the distance between the rotary axis of the roller and the longitudinal axis of the tube. More generally, formula I can be expressed in the following form:

$$R = \tfrac{1}{2} \cdot (WD - c \cdot D) \cdot \qquad \text{II}$$

wherein $c$ is a factor determining the rolling radius. It has the magnitude 1 when the rolling radius is equal to the roller radius in the region of the bottom of the sizing pass. If the peripheral velocity of the roller is greater than the velocity at which the tube passes through the sizing pass, at all points on the periphery of the tube which are touched by a roller under consideration, the value of $c$ also becomes greater than 1. On the other hand, if the peripheral velocity of the roller at all these peripheral points is lower than the velocity at which the tube passes through the sizing pass, the value of $c$ becomes smaller than 1 and assumes a value of up to a maximum of 0.5 for a three-roller sizing pass. If the value of $c$ is 0.5 or less, the roller applies to the tube a maximum tractive force in the opposite direction to the rolling direction, while, with a value of $c$ equal to or greater than 1, the roller applies to the tube a maximum tractive force in the rolling direction.

If the tension is maintained constant through a stand or varies to only a slight extent, the value of $c$ in the case of a three-roller sizing pass lies at approximately 0.9 according to the ratio of the diameter of the roller to the diameter of the tube, and in accordance with the reduction in diameter. The exact value results from the equilibrium of forces of the tube under the roller. When the tube has entered all the stands of a rolling mill, for example 24 stands, the tension is built up in the first sizing passes, for example in the first four to six sizing passes. This means that the first four to six sizing passes tension the tube by applying to the tube tractive forces in the opposite direction to the rolling direction. When using the maximum possible tractive forces, the $c$ values of the, for example three-pass rolling mill, must be approximately 0.5 and less. The last rolling sizing passes, for example the last five sizing passes reduce the tension, which means that the rollers apply tractive forces to the tube in the rolling direction and their $c$ values must be 1.0 and in excess of 1.0. The sizing passes 1 to 6 building up the tension are followed by the sizing passes 7 to 19 which maintain the tension at a constant value or only slightly vary the tension and which have $c$ values which lie between 0.8 and more than 0.9, the $c$ values decreasing slightly as the number of sizing passes increases, owing to the fact that the rollers are becoming larger.

It follows from the above that the $c$ values jump from approximately 0.5 to approximately 0.9 beyond, for example, the first six sizing passes which build up the tension. This means that the rotational speeds are also stepped up, that is a greater step-up ratio occurs between two adjacent sizing passes in the region of the transition from the sizing passes which build up tension to the sizing passes which maintain tension. The step up ratios are calculated from the continuity equation $$F \cdot V = F_1 \cdot V_1, \qquad \text{III}$$

in which the cross-sectional areas of the tube wall as the tube enters two successive sizing passes are designated F and $F_1$ respectively, and the velocities at which the tube enters the two sizing passes are designated V and $V_1$ respectively. If the formula for the peripheral velocity $$V = \frac{\pi \cdot n}{30} \cdot R \qquad \text{IV}$$

is introduced into formula III, one obtains $$F \cdot n \cdot R = F_1 \cdot n_1 \cdot R_1 \cdot \qquad \text{V}$$

The last-mentioned formula can be converted to $$\frac{n}{n_1} = \frac{F_1}{F} \cdot \frac{R_1}{R} = i \qquad \text{VI}$$

which denotes the step-up ration i.

If one introduces formula II into formula VI, one obtains $$i = \frac{F_K \cdot (WD_K - c_K D_K)}{F_{K+1}(WD_{K+1} - c_{K+1} \cdot D_{K+1})} \qquad \text{VII}$$

in which K denotes the number of the sizing passes. It will be seen from formula VII that the step-up ratios also change abruptly when the value of *c* changes abruptly, since the values of F and D vary substantially uniformly.

The foregoing shows the necessity for the steps of the value of *c* and thus also of the rotational speeds of the rollers. Thus, in the present context, the speed step refers to any abrupt increase in speed which occurs between one stand and the adjacent stand and which exceeds the required increase in speed which results from the elongation of the tube between the two stands. Usually, the speed step is provided between two adjacent sizing passes, for example, between the fifth and sixth sizing pass, while the sizing passes located in front thereof, for example the sizing passes 1 to 4, have substantially constant *c* values of, for example, 0.5 or less. If, in accordance with the invention, the speed step is shifted, for example, from sizing pass 6 to sizing pass 5, it is only necessary to vary the rotational speeds of the rolling stands 5 and 6. In this case, fewer sizing passes participate in building up the tension, and the smaller tensile force thus produced can no longer be compensated for by the following sizing passes, so that, in this example, the finished tube has a greater wall thickness. Basically, it is also possible to distribute the speed step to a plurality of sizing passes, and to provide a first partial step between for example the fourth and fifth sizing pass, and a second partial step between the fifth and sixth sizing pass. The invention can also be applied to this case, namely by shifting the partial steps in the rolling direction or in the opposite direction to the rolling direction, thus resulting in the same advantageous effect.

The above explanations relate to a stretch-reducing rolling mill having three rollers for each sizing pass. The same also applies to rolling mills having a different number of rollers for each sizing pass, only the *c* values being different.

The invention is further described, by way of example, with reference to the accompanying drawings, in which.

Figure 1:
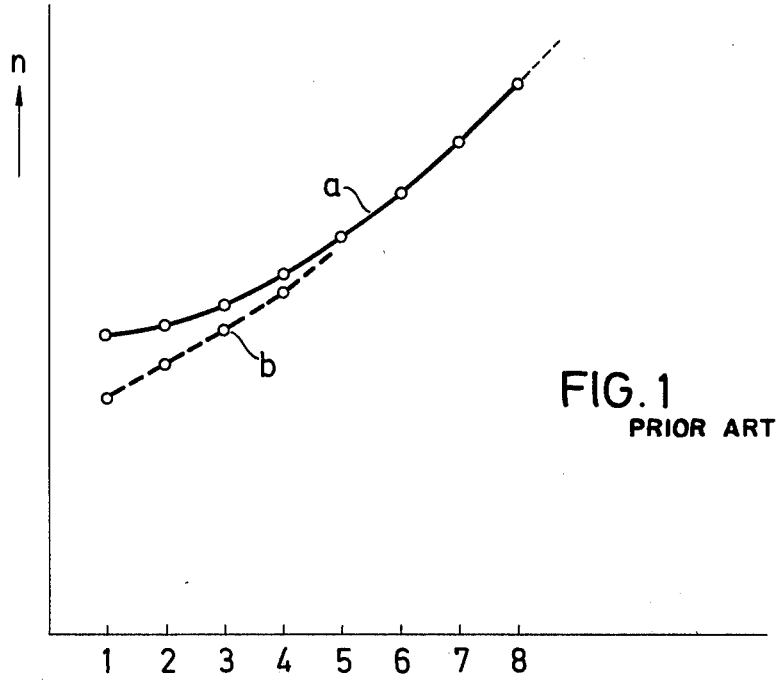
FIG. 1 PRIOR ART
FIG. 1 is a graph showing the roller speeds of a known rolling mill.
Figure 2:
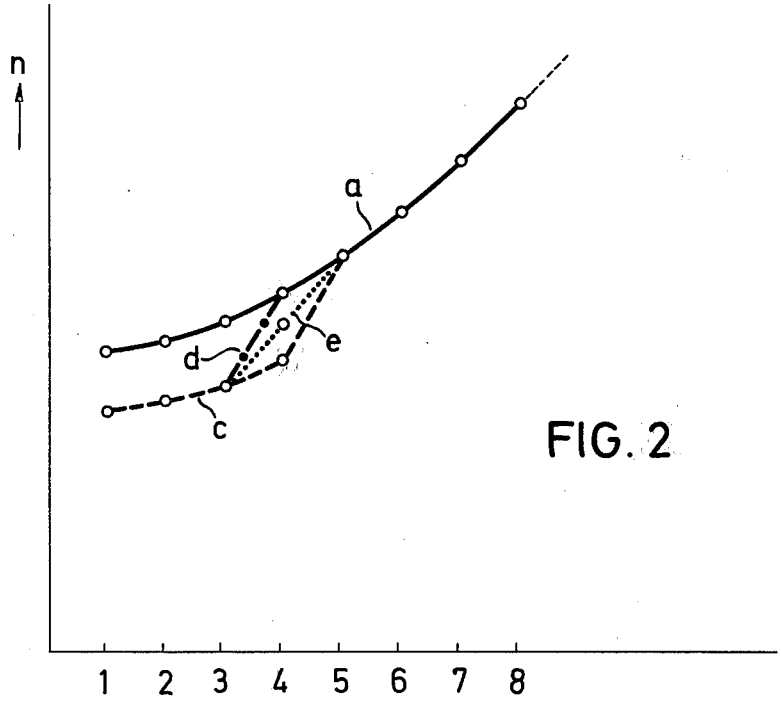
FIG. 2 is a graph showing the roller speeds of a rolling mill in accordance with the invention.

Referring to FIGS. 1 and 2, the order number of the stands, arranged one behind the other, of the known stretch-reducing rolling mill and the stretch-reducing rolling mill in accordance with the invention is plotted on the respective abscissae. The ordinate shows the rotational speed *n* of the rollers.

A curve, shown by a solid line, is designed *a* in FIG. 1. This curve is the speed curve which is calculated with a constant *c* value and in which only the reduction in the diameter and the change in the wall thickness of the tube have been taken into account. For the purpose of clarifying the illustration, it has been assumed that there is no change in the diameter of the rollers. As may be clearly seen, the rotational speeds increase substantially uniformly.

However, the known rolling mills do not operate in accordance with the aforementioned curve *a* in the region of the stands 1 to 5, but in accordance with the curve *b* shown by a broken line. This curve does not differ from curve *a* beyond stand 5. In the region of the stands 1 to 5 which are located in front in the rolling direction and which build up the tension, it may be clearly seen that a so-called speed correction has been effected for the purpose of building up the tension, the individual speeds having been greatly reduced to different extents. The greatest speed correction exists at the first stand, whereas it has been reduced to zero at the fifth stand. Thus, despite the correction which has been carried out, a substantially uniformly rising speed curve is produced without a marked speed step.

Referring to FIG. 2, the same calculated speed curve is again designated *a* and the curve *c* in accordance with the invention is shown by a broken line. The marked speed step between the fourth and the fifth stand can be clearly seen in curve *c*, and it can be seen that this curve extends approximately parallel below the curve *a* in the region of the first to the fourth stand. For the purpose of varying the change in the wall thickness, the speed step, for example, is shifted to the front, namely between the third and the fourth stand, as shown by the dash-dot line *d*. In this case, of course, the portion of the curve *c* shown by a dashed line, in the region of the stands 3 to 5 is omitted.

The dotted line *e* illustrates the embodiment of the invention in which the speed step is distributed to two stands, the stand locations 3 to 5 in the present instance. The line *e* can also be displaced forwardly or rearwardly, whereby the change in the wall thickness is varied over the entire rolling mill, although this has not been illustrated.

While we have illustrated and described certain preferred embodiments and practice in the foregoing specification, it will be understood that this invention may be otherwise embodied within the scope of the following claims.

We claim:

1. A multistand rolling mill for stretch-reducing tubes comprising a plurality of successive stands of rolls along a pass line, drive means for driving said rolls so that the peripheral speed of the rolls increases from stand to stand from inlet to outlet end of the pass line, the stands at the inlet end being stands in which tension is built, means acting on the rolls of at least one of said stands adjacent the inlet end in which tension is being built up individually varying the rotation speed of the rolls in said at least one stand whereby a rotational speed step is built up between the rolls of at least two stands of those inlet stands in which tension is built up, and means for shifting selectively the rotational speed change between the two front stands to the inlet and outlet ends of said mill.

2. A multistand rolling mill for stretch-reducing tubes as claimed in claim 1 wherein means act on the rolls of two successive stands in which tension is built up adjacent the inlet end of the pass line to vary their rotational speed to build up a speed step between the rolls of the roll stands preceding said two stands and the rolls of the roll stands following said two stands.

3. A multistand rolling mill for stretch-reducing tubes as claimed in claim 1 wherein the speed step is incorporated between the rolls of the third and fourth roll stands of a multistand rolling mill.

4. A multistand rolling mill for stretch-reducing tubes as claimed in claim 1 wherein the speed step is incorporated between the rolls of the fourth and fifth stands of a multistand rolling mill.

5. A multistand rolling mill for stretch-reducing tubes as claimed in claim 1 wherein the speed step is incorporated between the fifth and sixth stands of a multistand rolling mill.

6. A multistand rolling mill for stretch-reducing tubes as claimed in claim 1 wherein the speed step is incorporated between the third and fifth roll stands of a multistand rolling mill.

7. A method of rolling tubes to control wall thickness comprising the steps of a. passing a tube blank to be stretched reduced along a pass line through a plurality of successive stands of rolls;

b. driving the rolls of those stands at the entry end of the pass line at constant rotational speeds designed to build up tension in the tube blank being rolled;

c. driving the rolls of the stands following said those stands at constant speeds to substantially maintain tension on the tube blank;

d. imposing on the drive of at least one of said those stands designed to build up tension a speed step substantially greater than the normal progression of speed increases from roll stand to roll stand in said stands designed to build up tension; and e. selectively shifting the rotational speed change between the two front stands of the mill to the inlet and outlet ends of the mill.

8. A method as claimed in claim 7 wherein the speed step is imposed on the roll drives of two successive stands designed to build up tension.

9. A method of rolling tubes to control wall thickness comprising the steps of a. passing a tube blank to be stretched reduced along a pass line through a plurality of successive stands of rolls;

b. driving the rolls of those stands at the entry end of the pass line at constant rotational speeds designed to build up tension in the tube blank being rolled;

c. driving the rolls of the stands following said those stands at constant speeds to substantially maintain tension on the tube blank;

d. imposing on the drive of at least one of said those stands designed to build up tension a speed step substantially greater than the normal progression of speed increases from roll stand to roll stand in said stands designed to build up tension and wherein the speed increments between rolls of the roll stands are determined from the formula $$i = \frac{F_K(WD_K - c_K D_K)}{F_{K+1}(WD_{K+1} - c_{K+1} \cdot D_{K+1})}$$

in which $i$ is the step up ratio, $K$ is the number of sizing passes, $D$ is the external diameter of the tube being rolled, $WD$ is the ideal roller diameter (twice the distance between the rotary axis of the roll and the longitudinal axis of the tube), $F$ is the cross-sectional area of the tube wall and $c$ is a factor determining roll axis, said rolls designed to build up tension having $c$ values below 0.5, the speed step rolls having values in excess of 1.0 and the rolls following those designed to build up tension having $c$ values of at least 0.9.

* * * * *